US005102100A

United States Patent [19]

Troncoso, Jr.

[11] Patent Number: 5,102,100

[45] Date of Patent: Apr. 7, 1992

[54] ARCHERY ARROWHEAD PULLER DEVICE

[76] Inventor: Fernando Troncoso, Jr., 14090-6100 Rd., Montrose, Colo. 81401

[21] Appl. No.: 631,870

[22] Filed: Dec. 21, 1990

[51] Int. Cl.[5] ..... B66F 3/00

[52] U.S. Cl. ..... 254/129; 254/131; 29/267

[58] Field of Search ..... 29/267, 282, 214, 219, 29/220; 254/131, 129, 130

[56] References Cited

U.S. PATENT DOCUMENTS

| | | | |
|---|---|---|---|
| 2,629,584 | 2/1953 | Cannon | 29/267 |
| 2,940,167 | 6/1960 | Boyer et al. | 29/267 |
| 3,274,675 | 9/1966 | Jackson | 29/267 |
| 3,441,251 | 4/1969 | Burns | 29/267 |
| 3,747,195 | 7/1973 | Rigsby et al. | 29/267 |
| 3,826,471 | 7/1974 | Orton et al. | 29/267 |
| 3,873,068 | 3/1975 | Allen | 29/267 |
| 4,266,330 | 5/1981 | Conte | 29/267 |

*Primary Examiner*—Robert C. Watson
*Attorney, Agent, or Firm*—Donald E. Nist

[57] ABSTRACT

The archery arrowhead puller is particularly adapted for pulling broadheads as well as field points from buried positions in trees, tree stumps and the like without injury to the points. The device includes an elongated horizontal lever bar with a pair of hinged arms spaced along the length thereof and depending therefrom. The arms preferably are moveable between the hanging vertical position and a horizontal position and rotate in a plane along the longitudinal axis of the bar. One of the arms is a brace arm and is positioned at about the front of the bar while the other arm is a puller arm spaced rearwardly thereof. The brace arm has a pointed lower end preferably detachable from its remainder. Both the arms preferably have spaced transverse hinge holes in order to regulate their effective lengths. The bar preferably also has spaced transverse hinge holes and a slideable sleeve over the rear end thereof for extending the length of the bar for increased leverage. The lower end of the puller arm has an internally threaded space to threadably receive the rear threaded connector of the arrowhead in order to pull it easily from the buried position. Preferably, that lower puller arm end is tapered down to facilitate reaching buried connectors. The device is preferably of steel and is simple and efficient.

7 Claims, 1 Drawing Sheet

ARCHERY ARROWHEAD PULLER DEVICE

BACKGROUND OF THE INVENTION

1. Field of the Invention

The present invention generally relates to sports devices and more particularly to an archery device which facilitates pulling archery arrowheads from buried positions in trees and the like.

2. Prior Art

Various devices have been constructed for the purpose of pulling arrowheads from buried positions. Broadheads which are used for hunting purposes are very expensive and frequently become lodged in tree trunks and the like when the archer misses with his shot at the game. It becomes necessary to extract the broadhead from its buried position, hopefully without damage to the broadhead. Also when field shooting a field point is used on the arrow. Such field points often become lodged in trees and the like when the targets are missed. The arrow in both instances can be detached from the field point or broadhead and saved, but special effort is needed to retrieve the broadhead or field point.

One prior art field point and broadhead puller is T-shaped but difficult to use without torquing and damaging the broadhead or field point during its extraction. The same is true of a combination bow stabilizer- arrowhead puller. Less popular is a piston-type percussive puller which hammers the arrowhead out of its buried position, also with danger of damage to the arrowhead. Another such device is constructed of a plurality of molded plastic parts which must be carried separately and assembled at the point of use. There is inconvenience with this device, danger of losing its parts and considerable time needed for assembling the device in order to use it.

There remains a need for a simple, durable, easy to use, efficient and rapid puller which does not damage the arrowhead, even those buried at an acute angle in a tree or the like. Such device should be equally efficient with broadheads and with field points and other arrowheads.

SUMMARY OF THE INVENTION

The improved arrowhead puller of the present invention satisfies all the foregoing needs. The puller is substantially as set forth in the Abstract of the Disclosure.

Thus, the puller comprises an elongated bar, preferably of steel, which preferably has an over-sleeve at its rear end which is slideable to extend the length of the bar for better leverage.

The device further includes a brace arm at about the front end of the bar, hinged to the bar so as to swing between the vertical and horizontal along the main axis of the bar, and depending therefrom. The brace arm has a pointed lower end which may be detachable from the rest of the arm to replace it if and when damaged and to increase or shorten the length of the brace arm.

The device further includes a puller arm rearward of the brace arm and similarly hinged to the bar, depending therefrom and bearing at its lower end a threaded space adapted to threadably receive the threaded rear end of an arrowhead connector typically used with broadheads and field points. Preferably, that lower end of the puller arm is tapered down to facilitate reaching buried rear ends of arrowhead connectors.

Both arms preferably have a plurality of vertically spaced transverse hinge holes so as to effectively adjust their heights relative to the bar. The bar preferably has a plurality of transverse hinge holes spaced along the length thereof in order to adjust the positions of the arms thereon for improved operation and leverage of the device.

Further features of the present invention are set forth in the following detailed description and accompanying drawings.

DRAWINGS

DETAILED DESCRIPTION

Figure 1:
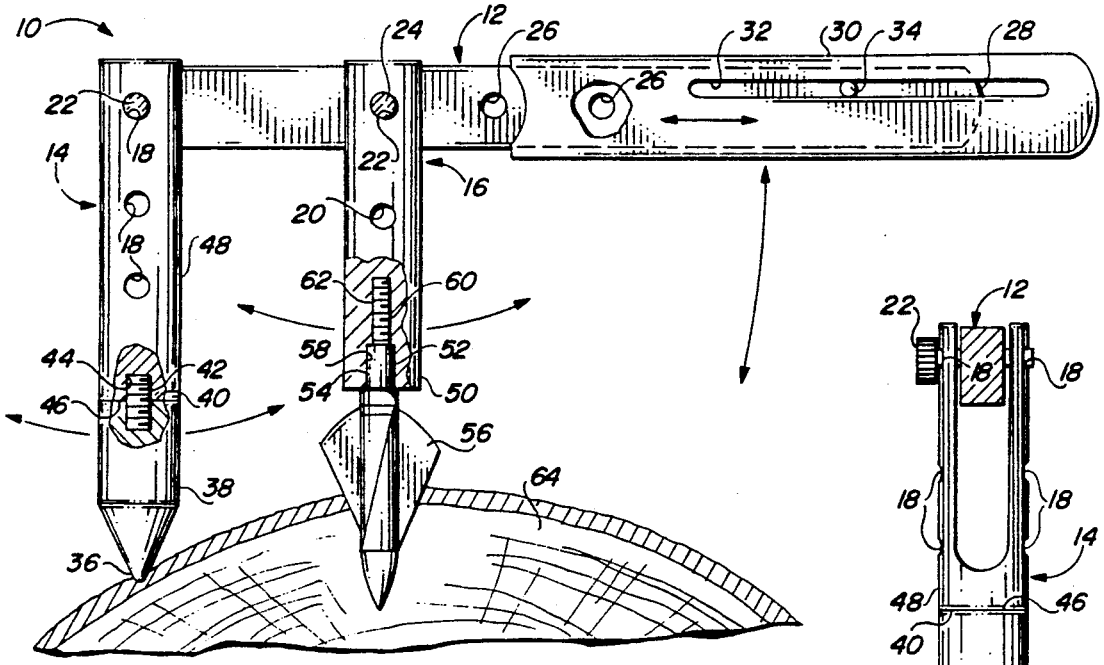
FIG. 1 is a schematic side elevation, partly broken away, of a preferred embodiment of the improved arrowhead puller device of the present invention, shown attached to a broadhead buried in a tree.
Figure 2:
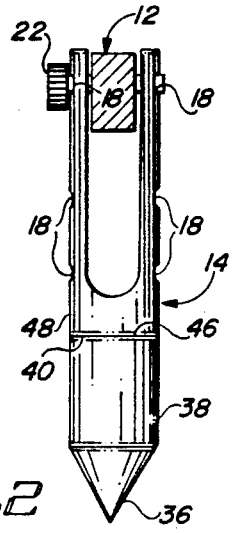
FIG. 2 is a schematic front elevation of the brace arm of FIG. 1.
Figure 4:
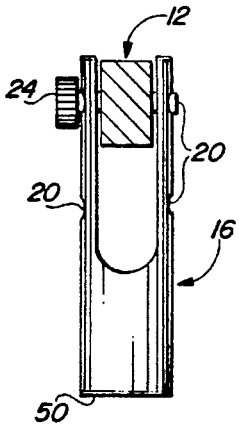
FIG. 4 is a schematic front elevation of the puller arm of FIG. 1.

FIGS. 1, 2 and 4

Now referring more particularly to FIGS. 1, 2 and 4 of the drawings, a preferred embodiment of the improved arrowhead puller device of the present invention is schematically depicted therein. Thus, device 10 is shown which comprises an elongated bar 12 of durable material such as steel, and a brace arm 14 of steel or the like, as well as a puller arm 16 of steel or the like. Both arms 14 and 16 are hinged to bar 12 through hinge holes 18 and 20, respectively, and removable headed hinge pins 22 and 24, respectively, so as depend vertically therefrom and to rotate in a plane along the longitudinal axis of bar 12 between vertical and horizontal positions, as indicated by the arrows in FIG. 1.

Bar 12 has a plurality of transverse hinge holes 26 spaced along the length thereof, so that arms 14 and 16 can be positioned as needed for the most effective leverage in removing an arrowhead without twisting, torquing or breaking it. Moreover, the rear end 28 of bar 12 is covered by a sleeve 30 preferably of metal and bearing a longitudinal slot 32 therein through which a side pin 34 connected to end 28 extends to limit the movement of sleeve 30. Sleeve 30 allows the effective length of bar 12 to be adjusted for the proper amount of leverage needed to accomplish the pulling operation.

Arm 14 has a plurality of vertically spaced hinge holes 18 to enable the effective length of arm 14 to be adjusted. As can be seen in FIG. 2, arm 14 is cut away to accommodate bar 12. Arm 16 is similarly cut away and provided with a plurality of vertically spaced hinge holes 20 to enable the effective length of arm 16 to be adjusted.

The bottom end 36 of arm 14 is pointed and the lower section 38 of arm 14 is detachable from the remainder thereof so that sections 38 of different lengths can be used and can replace damaged ends 36. In this regard, the upper end 40 of section 38 is provided with an upwardly projecting screw 42 threadably releasably received in a threaded cavity 44 in the lower end 46 of the upper section 48 of arm 14.

The lower end 50 of arm 16 is provided with a central cavity 52 dimensioned to receive the rear connector 54 of an arrowhead such as broadhead 56 shown in FIG. 1. The lower portion 58 of cavity 52 is expanded and the upper portion 60 thereof is threaded to threadably receive the rear threaded end 62 of connector 54, as shown. When threaded onto connector 54, as shown in FIG. 1, arm 16 and device 10 can be easily used to safely, swiftly and simply pull broadhead 56 from tree 64. In this regard, arm 14 is braced by its point 36 against tree 64 after screwing arm 16 onto connector 54 while arm 14 is extended about horizontally, that is, out of the way. When device is in the position shown in FIG. 1, arrowhead 56 is safely lifted directly out of tree 64 without damaging arrowhead 56, merely by lifting up on bar 12.

The above description and orientation of components of device 10 are made with respect to a situation where arrowhead 56 is buried vertically. In most instances, arrowhead 56 will be buried about horizontally. In such instance, arms 14 and 16 and bar 12 will all be in a horizontal plane and bar end 28 will be moved away from tree 64 in levering broadhead 56 out of tree 64. Whatever the orientation of arrowhead 56 in tree 64, device 10 can be easily applied to it , that is, threaded on it and used to safely lever it out of tree 64. It is necessary that arms 14 and 16 rotate as described so that arms 14 and 16 can easily accommodate different tree diameters and arrowhead angles therein, all without straining device 10 and arrowhead 56. Thus, device 10 is safe, simple, efficient and rapid to use.

FIG. 3

Figure 3:
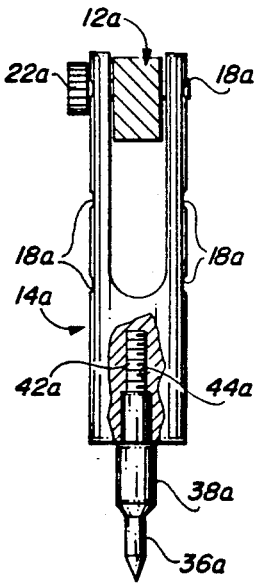
FIG. 3 is a schematic front elevation, partly broken away, of a first modified version of the brace arm of the present invention.

A modified version of the brace arm used in the device of the present invention is schematically depicted in FIG. 3. Thus, arm **14*a* is shown. Components thereof similar to those of arm 14 bear the same numerals but are succeeded by the letter "a". Arm 14*a* is identical to arm 14, except as follows: a) point 36*a* and section 38*a* have a different shape than point 36 and section 38 and may be, if desired, a field point or the like threaded by screw 42*a* into cavity 44*a***.

FIG. 5

Figure 5:
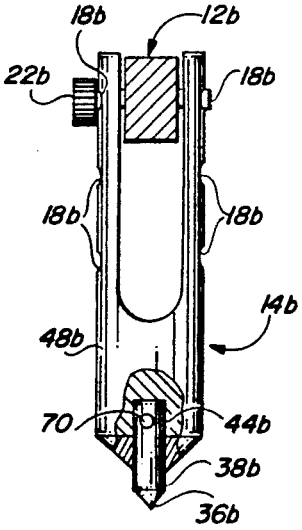
FIG. 5 is a schematic front elevation, partly broken away, of a second modified version of the brace arm of the present invention; and, FIG. 6 is a schematic side elevation, partly broken away, of a modified version of the puller arm of the present invention.

A further modified version of the brace arm is shown in FIG. 5. Thus, arm **14*b* is shown. Components thereof similar to those of arm 14 bear the same numerals but are succeeded by the letter "b". Arm 14*b* is identical to arm 14 except that point 36*b* is connected to a pin 38*b* releasably held in unthreaded cavity 44*b* by a pin 70 extending through section 48*b***.

FIG. 6

Figure 6:
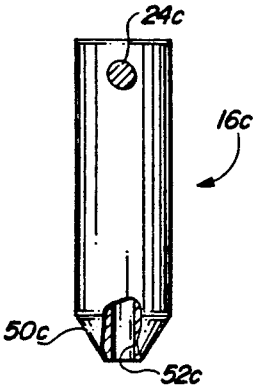

A modified version of the puller arm of the present invention is schematically set forth in FIG. 6. Thus, arm **16*c* is shown. Components thereof similar to those of arm 16 bear the same numerals but are succeeded by the letter "c". Arm 16*c* is identical with arm 16 except that lower end 50*c* thereof is tapered down so that buried connector ends of arrowheads can be more easily reached with less digging around the arrowhead. Arm 16*c* has the other features of arm 16**.

It will be noted that arms **14*a*, 14*b* and 16*c* can be substituted as desired for arms 14 and 16 in device 10** and still provide all the desired features of the present invention. Various other modifications, changes, alterations and additions can be made in the improved device of the present invention, its components and their parameters. All such modifications, changes, alterations and additions as are within the scope of the appended claims form part of the present invention.

What is claimed is:

1. An improved Archery arrowhead puller device, said device comprising, in combination:

a) a horizontal elongated bar having opposite front and rear ends;

b) a brace arm hinged to said bar adjacent to the front end of said bar and depending therefrom and moveable from a vertical to a horizontal position; and c) an arrowhead puller arm hinged to said bar at a position spaced from and rearwardly of said first arm and depending from said bar, the lower end of said puller arm having a threaded aperture means for threadably receiving the rear connector end of an arrowhead, said bar having a plurality of transverse hinge holes along the length thereof at which to releasably secure said two arms.

2. The improved device of claim 1 wherein said bar has a slideable sleeve over the rear end thereof with which to extend the effective length of said bar for improved leverage.

3. The improved device of claim 1 wherein said two arms each have a plurality of vertically spaced transverse hinge holes therethrough for adjusting the effective heights thereof.

4. The improved device of claim 1 wherein the bottom end of said brace arm is pointed and is releasably secured to the remainder of said arm.

5. The improved device of claim 1 wherein the lower end of said puller arm is tapered down to facilitate pulling of buried arrowheads.

6. The improved device of claim 1 wherein said brace arm lower end comprises a pointed tube releasably pinned to the remainder of said brace arm.

7. The improved device of claim 1 wherein said arms are hinged to said bar so as to rotate along the longitudinal axis of said bar between a vertical and horizontal position.

* * * * *